US005485145A

United States Patent [19]

Sniff

[11] Patent Number: 5,485,145

[45] Date of Patent: Jan. 16, 1996

[54] ELECTROLUMINESCENT SIGN CONVERSION KIT

[75] Inventor: Donald Sniff, Middleburg Heights, Ohio

[73] Assignee: Emergency Safety Products, Inc., East Pittsburgh, Pa.

[21] Appl. No.: 667,139

[22] Filed: Mar. 11, 1991

[51] Int. Cl.[6] ..... G08B 7/00

[52] U.S. Cl. ..... 340/815.4; 345/45; 40/544; 40/570

[58] Field of Search ..... 40/544, 570; 340/760, 340/815.01, 815.04, 815.05, 815.14, 815.4, 815.49, 815.66; 359/69; 358/254; 345/30, 45, 36

[56] References Cited

U.S. PATENT DOCUMENTS 3,381,401 4/1966 Fuller, Jr. .
3,680,237 8/1972 Finnerty, Sr. ..... 40/544
3,780,462 12/1973 Pregel et al. ..... 40/544
3,869,637 4/1975 Usui ..... 313/500
4,385,343 5/1983 Plumbly ..... 40/546
4,466,208 8/1984 Logan, Jr. et al. ..... 40/544
4,487,481 12/1984 Suzawa ..... 359/69
4,489,308 12/1984 Logan, Jr. et al. ..... 340/286
4,682,147 7/1987 Bowman ..... 340/286
4,999,936 3/1991 Calamia et al. ..... 40/544
5,053,881 8/1991 Campisi ..... 358/254

*Primary Examiner*—Tommy P. Chin
*Assistant Examiner*—Doom Chow
*Attorney, Agent, or Firm*—Buchanan Ingersoll; Lynn J. Alstadt

[57] ABSTRACT

Disclosed herein is a conversion kit whereby building or plant signs illuminated by incandescent bulbs or fluorescent tubes may be converted to electroluminescent illumination. The kit includes an electroluminescent panel and an opaque sign mask, The opaque sign mask is adapted to overlie the electroluminescent panel and the sign indicia of the mask are in the nature of stencil like cutouts to allow the light emitted by the underlying electroluminescent panel to pass only through the indicia cutouts.

16 Claims, 4 Drawing Sheets

ELECTROLUMINESCENT SIGN CONVERSION KIT

BACKGROUND OF THE INVENTION

1. Field of the Invention

The present invention relates generally to electrically illuminated signs and is more particularly directed to a kit of interacting components whereby signs originally lighted by incandescent bulbs or fluorescent light tubes may be conveniently converted to electroluminescent lighting.

2. Description of the Prior Art

In many public buildings and industrial plants there are provided illuminated cautionary and/or informational signs which define exits, stairwells, fire alarms, equipment-in-use, hazardous areas and the like. Such signs are conventionally illuminated by incandescent bulbs or fluorescent tubes which operate on 110–120 volt AC house current. Incandescent bulb or fluorescent tube lamps are relatively tender objects which are subject to breakage and their service lives are not great, particularly when subject to the vibration that is often experienced in public building and industrial plant setting installations. It is generally desirable, therefore, that the incandescent or fluorescent lighting systems of such signs be replaced by illuminating means which are more energy efficient, which are less prone to breakage and which have longer service lives. In addition, it is also desirable that the replacement illuminating means be operable by a backup battery power supply in the event of house current disruptions.

The closest prior art known to applicant in respect of the present invention is represented by a line of exit signs manufactured and sold by Don Gilbert Industries, Inc., Jonesboro, Arkansas. Said signs are described, in detail, in U.S. Pat. No. 4,682,147, to Norman E. Bowman, dated Jul. 21, 1987, entitled EMERGENCY SIGN. These signs are based upon a light emitting diode (LED) display comprising a multiplicity of LED components arranged and affixed to a display board in the form of the specific information desired to be displayed. Electrical circuitry is provided to receive AC line current and to transform and rectify it to an appropriate DC voltage power output to the LED display. In addition, the power supply circuitry to the LED panel is provided with means by which to sense AC line current power outages and, in response to such outages, to switch the LED panel display to battery power and, in addition, to convert the normally continuously lighted display to a flashing display. While the Bowman emergency signs address many of the problems associated with signs illuminated by incandescent bulbs or fluorescent tubes including, to some extent, the problem of short bulb service life and the capacity to continue operations under power outages, nevertheless they, too, are possessed of certain deficiencies. For instance, the Bowman sign displays are dependent upon a plurality of groups of series wired LED components which must be prepared and affixed to the display at the site of manufacture. Therefore, the specific informational and/or symbolic displays desired by the customer must be prepared at the site of manufacture of the sign and cannot thereafter be altered or supplemented at the installation site. Secondly, the arranging and making of the many electrical connections required between the multiplicity of LED components of the Bowman LED display panels is a relatively time consuming, labor intensive and, therefore, expensive manufacturing task. Moreover, these many electrical connections between the LED components, whether accomplished by printed circuitry or hard wiring, constitute a statistically meaningful population of potential sites for failure during installation and use. Since a plurality of groups of the LED components are required to be connected in series in the Bowman emergency light device, the failure of even a single such connection or LED component invariably affects at least one LED grouping of the display and can, therefore, conceivably render the information displayed by the sign nonsensical or unintelligible. Another problem associated with the Bowman emergency light system resides in the need for employing transformer/rectifier circuitry during normal operations in order to supply the necessary DC voltage to the LED display. Thus, independent electronic elements which are themselves subject to failure during normal operations are necessarily interposed between the LED display and the AC house line current power source. In accordance with the present invention, however, there is provided an illuminated sign conversion kit wherein these aforementioned problems attendant prior art devices have either been substantially completely resolved or at least substantially ameliorated.

Objects of the Invention

It is a principal object of the present invention to provide a novel illuminated sign assembly.

It is another object of the invention to provide a novel conversion kit by which existing illuminated signs utilizing incandescent bulb or fluorescent tube illumination can be conveniently converted to an illuminated sign system of improved service life and energy efficiency.

It is yet another object of the invention to provide a novel illuminated sign conversion kit wherein the word and/or symbolic information to be conveyed thereby can be prepared or altered at the installation site.

It is still another object of the invention to provide a novel illuminated sign assembly wherein the illuminating component thereof is directly powered by AC line current.

Other objects and advantages of the present invention will in part be obvious and will in part appear hereinafter.

SUMMARY OF THE INVENTION

In accordance with the invention there is provided a sign illumination kit comprising an electroluminescent panel having a light emitting surface, said panel being adapted to be placed into electrical communication with a source of AC line current and an opaque sign mask adapted to be disposed over the light emitting surface of the electroluminescent panel. Prior to installation the opaque sign mask has the desired letter and/or symbolic indicia of the sign cut therefrom in the nature of one or more stencil like cutouts whereby, in the assembled kit, the light emitted from the underlying electroluminescent panel is permitted to pass only through said cutouts. A protective light transmissive panel is preferably interposed between the electroluminescent panel and the opaque sign mask.

DESCRIPTION OF THE PREFERRED EMBODIMENTS

Figure 1:
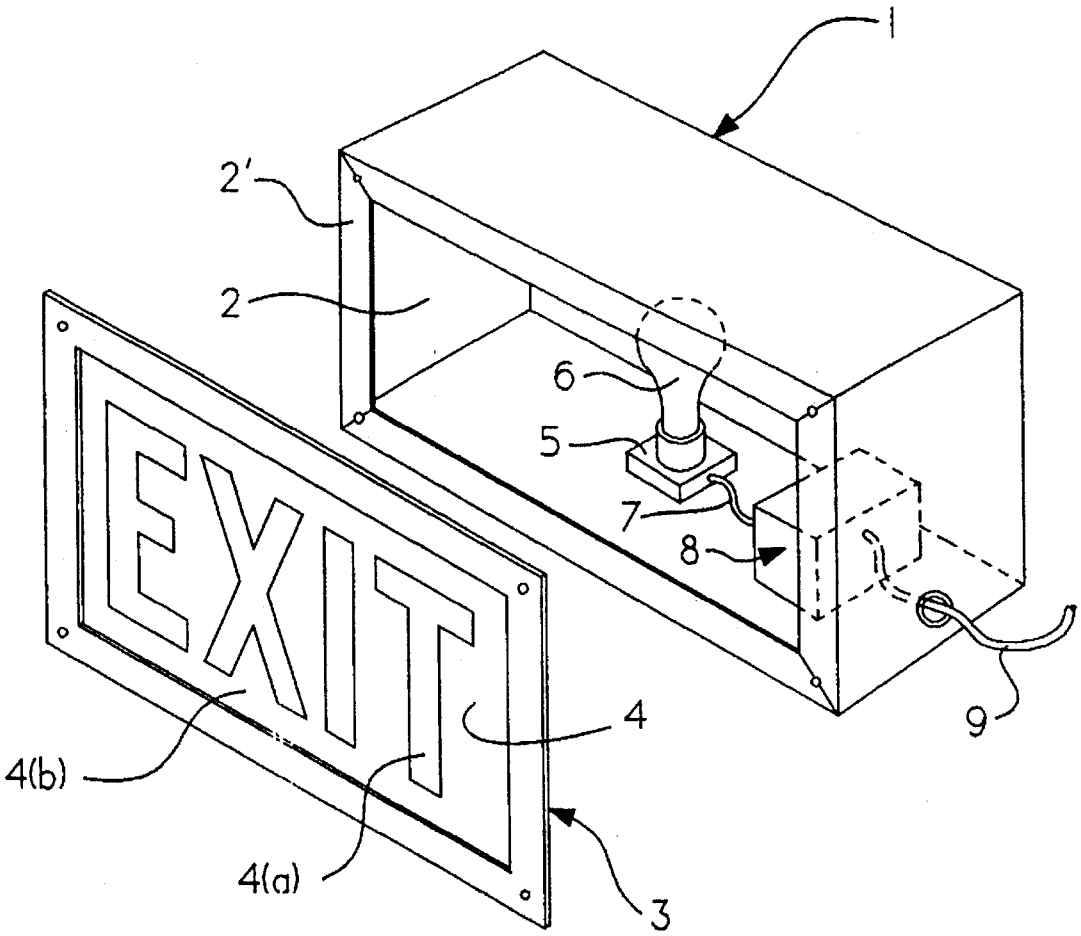
Fig.1. Prior Art
FIG. 1 is a perspective exploded view of a typical illuminated sign of the prior art wherein the light source is an incandescent bulb powered by AC line current and wherein emergency power to the bulb in the event of a line current outage is provided by a battery pack/inverter/transformer system.

Referring now to FIG. 1, there is shown a typical illuminated EXIT sign fixture of the prior art which comprises a housing 1 having an open side 2 defined by flange 2', a removable frame element 3 and a sign element 4. The sign element 4 is typically conformed of a glass or plastic pane wherein the letters of the word, EXIT, are defined by clear or light transmitting areas 4(*a*) of the pane while the entire remaining area 4(*b*) thereof is opaque. The frame element 3 is removably secured to the flange 2' of the housing 1 with the sign element 4 being interposed between the frame element 3 and the flange 2', thereby securing the sign element 4 to the housing 1 while also providing convenient maintenance access to the interior of the housing 1. Secured to the interior of the housing 1 is a lamp socket 5 equipped with an incandescent bulb 6. The socket 5 is in electrical communication with AC house current through line 7 which, in turn, is connected to an AC house current power supply cord 9.

In illuminated signs of this nature there is also desirably provided means by which emergency illumination of the sign is achieved in the event of a disruption in the supply of AC house current. In the embodiment of the prior art shown in FIG. 1 this capability is provided by a battery pack/inverter/transformer system 8. Under normal conditions, when house line current is available, the AC line current flowing through power supply cord 9 bypasses the battery pack/inverter/transformer system 8 and flows directly to the lamp socket 5 through line 7. The battery pack/inverter/transformer system 8 can also comprise a trickle charger element. Where this is so, a portion of the current supplied through AC power supply cord 9 can be employed to power the trickle charger element, thereby to maintain a full charge of the battery component of the system. In the event of a disruption in current flow through the power supply cord 9 the battery pack/inverter/transformer system 8 automatically switches to battery operation whereby the battery component supplies DC current to the inverter and transformer components and whereby the battery supplied DC input is converted to a 110–120 volt AC output which flows through line 7 to the lamp socket 5.

Referring now to FIGS. 2 through 5, wherein like reference numerals refer to like structures, the present invention comprises a kit of interactive components to replace the sign element 4, lamp socket 5 and incandescent bulb 6 of the prior art illuminated sign of FIG. 1. Broadly speaking, the present invention comprises an electroluminescent panel 10 having a light emitting phosphor surface 11 and an opaque sign mask 20 adapted to overlie the light emitting phosphor surface 11 of said electroluminescent panel 10. Desirably, for reasons which will be discussed in more detail hereinafter, the invention also includes a light transmissive panel 30 which is preferably interposed between the electroluminescent panel 10 and the opaque sign mask 20.

The electroluminescent panel 10 component of the conversion kit of the invention is a multi-layer composite structure comprising a base support layer composed of a nonconductive plastic panel or sheet which is coated with a metallic, electrically conductive foil layer and which metallic electrically conductive foil layer is overcoated with an electroluminescent light emitting phosphor layer 11. Desirably, the plastic base layer of the electroluminescent panel 10 is thin and relatively stiff, but flexible. The base layer serves as a non-conductive support for the intermediate metallic foil electroconductive layer and the phosphor layer 11. The intermediate metallic foil layer serves as an electrode through which electric energy is delivered to the electroluminescent phosphor layer 11 coated thereover. The conductors 12(*a*) and 12(*b*) of twin conductor cable 12, which is physically bonded to the base layer, are in electrical communication with the electroconductive foil layer of the electroluminescent panel 10. Cable 12 has a free end which terminates in a connector element 14(*a*). In general, a preexisting battery back/inverter/transformer system 8 utilized in conjunction with the incandescent bulb or fluorescent tube illumination of the original sign fixture will also be found to be operable with respect to an electroluminescent panel 10 component of the present invention. Where this is so the electrical aspect of the conversion of the fixture of FIG. 1 to employ the electroluminescent panel 10 of the present invention is achieved by cutting the line 7 and, preferably, removing the lamp socket 5 from the housing 1. The free end of the remaining line 7 extending from the battery pack/inverter/transformer system 8 is then provided with a connector element 14(*b*) cooperative with the connector element 14(*a*) and the electrical communication between the cable 12 of the electroluminescent panel 10 and the AC house current is established simply by mating of the mutually cooperative connector elements 14(*a*) and 14(*b*). Alternatively, where operational capability under AC house power outages is not required, the battery pack/inverter/transformer system 8 is preferably removed from the housing 1 and the electrical communication between the electroluminescent panel 10 with the AC house power similarly established by means of suitable cooperative connector elements between the cable 12 and the power supply cord 9. Upon excitation of the phosphor layer 11 of electroluminescent panel 10 with AC house current supplied through cable 12, the phosphor layer 11 emits a soft diffuse light across its entire surface. We prefer to use an electroluminescent panel having green phosphors because this color can be seen through smoke. However, other colors such as red or blue are commercially available and could be used if desired.

Electroluminescent panels 10 of the type described above are commercially available from BKL, Inc. and Luminescent Systems, Inc. According to the specifications provided by the manufacturer, these panels emit about 10 footcandles initially which reduces to 5 footcandles after 5,000 hours operation under alternating current excitation conditions of 110–120 volts and at a frequency of 60 Hz. Moreover, the manufacturer's reported power usage of an electroluminescent panel 10 of 7×12 inch dimensions is only about 2 watts, which represents a substantial improvement in energy efficiency over incandescent bulb or fluorescent tube illumination of a sign of about equivalent sign surface and brightness. This energy efficiency benefit of the invention becomes particularly apparent when consideration is given to the fact that most commercial buildings and industrial plants require a multiplicity of illuminated signs of the type comprehended by the present invention.

For a small office building having seventeen conventional double lamp exit signs the savings which can be achieved by use of the present invention may exceed $1,000.00 per year. Many conventional exit signs have two 25 watt lamps and thus require 50 watts. Assuming that the cost of electricity is 9 cents per kilowatt hour, the energy savings can be calculated as follows:

a conventional double 25 watt lamp exit sign=50 watts=0.05 kW 0.05 kW×24 hrs.×365 days=438 kWh per year 438 kWh×$0.09/kWh=$39.42 per year In addition, the lamps in a conventional sign must be replaced on average three times per year at a cost of $1.25 per lamp plus labor. The replacement lamp costs for a single lamp fixture is $3.75 per fixture and for a double lamp fixture is $7.50 per fixture. We can assume that the three lamp changes will require a total of two manhours at a labor rate of $10.00 per hour, thus, the annual operational costs per sign are $39.42 energy cost plus $7.50 replacement lamp cost plus $20.00 labor cost which totals $66.92. After conversion the exit sign will require no lamp replacement and consume only 2 watts. Thus, the annual operational cost for a converted sign is 2 watts=0.002 kW 0.002 kW×24 hrs.×365 days×$0.09/kWh=$1.58

Consequently the annual energy savings per sign after conversion is $39.42–$1.58=$37.84. For the total savings we must add the lamp replacement and labor costs which have been eliminated by conversion. Thus, the total savings is $37.84+$7.50+$20.00=$65.34 per sign For 17 signs the annual savings from the conversion will be

17×$65.34=$1,110.78.

Thus, the energy efficiency benefit of the invention is cumulative in nature.

Yet another benefit provided by the use of electroluminescent panel 10 in the present invention resides in the fact that, unlike incandescent bulbs or fluorescent tubes, very little heat is generated in the operation of electroluminescent panels. Therefore, illuminated sign fixtures utilizing the conversion kit of the present invention enjoy cool operations and impose no heat burden upon surrounding structures.

Opaque sign mask 20, bearing letter or symbolic indicia thereon in the form of stencil cutouts 21, is adapted for disposition over the light emitting or phosphor coated surface 11 of the electroluminescent panel 10 and to replace the glass or plastic pane sign element 4 (FIG. 1) of the original illuminated sign. Desirably, the opaque sign mask 20 is comprised of a thin and stiff, but flexible, thermoplastic sheet material having a thickness of between about 0.010 and about 0.035 inch, said sheet having been rendered opaque by incorporation of a suitable pigment or colorant therein. Suitable representative thermoplastic materials for the opaque sign mask 20 are, for instance, celluloid, polymethylmethacrylate, polycarbonate, polyethyleneterephthalate, polyamide, polyethylene and the like. I have found black pigmented plastic sheet materials to constitute a particularly preferred material of construction for the opaque stencil mask 20, the black pigmentation presenting a cosmetically attractive appearance as well as conferring substantial resistance to ultraviolet and ozone degradation and/or aging of the mask under a wide variety of environmental conditions. In addition, a black colored mask 20 provides a background which, even under ambient light conditions, contrasts nicely with the inherently light coloration of the underlying light emitting phosphor surface 11. Utilizing such plastic sheet materials the stencil cutouts 21, representing the letter, word and/or symbolic information to be conveyed by the sign, can be prepared at the installation site or can be diecut from the opaque sheet material by the manufacturer of the conversion kit of the invention. Said stencil cutouts 21, of course, yield an opaque sign mask 20 in the nature of a stencil whereby, when disposed over the electroluminescent panel 10, only those portions of the light emitting surface 11 of the electroluminescent panel 10 underlying the cutouts 21 are visible from the exterior of the illuminated sign.

In a preferred embodiment of the invention there is also provided a light transmissive panel 30 which is adapted to be interposed between the electroluminescent panel 10 and the opaque sign mask 20. Said light transmissive panel 30, which is preferably essentially optically clear, serves as: (1) a protective shield for the light emitting phosphor surface 11 of electroluminescent panel 10; (2) a support for the opaque sign mask 20 overlying said electroluminescent panel 10, as will be discussed hereinafter in respect of another preferred embodiment of the invention; and (3) a support and centering means for the electroluminescent panel 10. Since the light emitted by the electroluminescent panel 10 is inherently in the nature of a soft diffuse glow, there is ordinarily no need for further diffusion thereof. However, should such further diffusion be desired, the light transmissive panel 30 can be frosted or contain light diffusing fillers. As in the case of the opaque sign mask 20 component, it is preferred that the light transmissive panel 30 be composed of a stiff, flexible, thin thermoplastic sheet material such as celluloid, polymethylmethacrylate or polyethyleneterephthalate. I have found polycarbonate sheet materials to represent an excellent material of construction for the light transmitting panel 30 due to the optical clarity thereof and further due to the toughness and excellent abrasion resistance generally exhibited by polycarbonate sheet materials. I also prefer that the thickness of the plastic sheet material employed in the fabrication of the light transmissive panel 30 be within the range of 0.010 and 0.035 inch.

Figure 2:
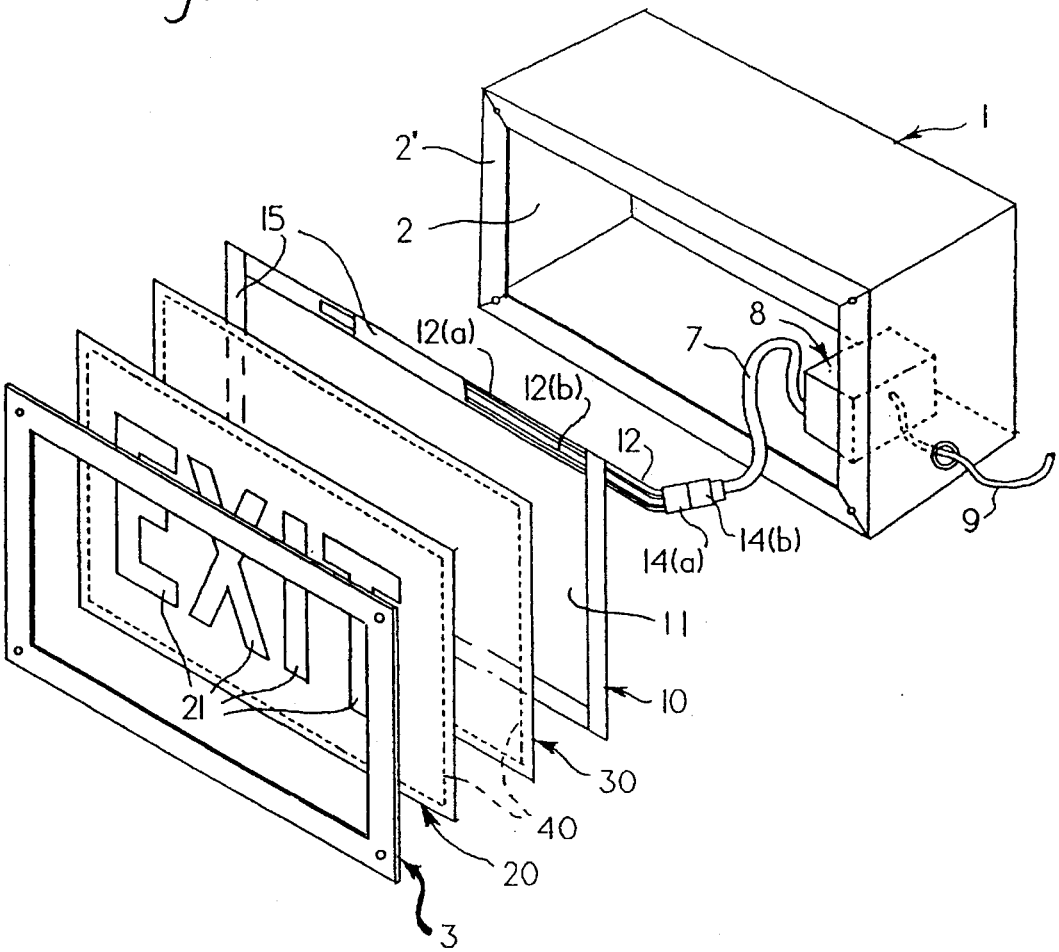
FIG. 2 is a perspective exploded view of the sign of FIG. 1 wherein original operative sign elements thereof have been replaced by an embodiment of the conversion kit of the present invention.
Figure 3:
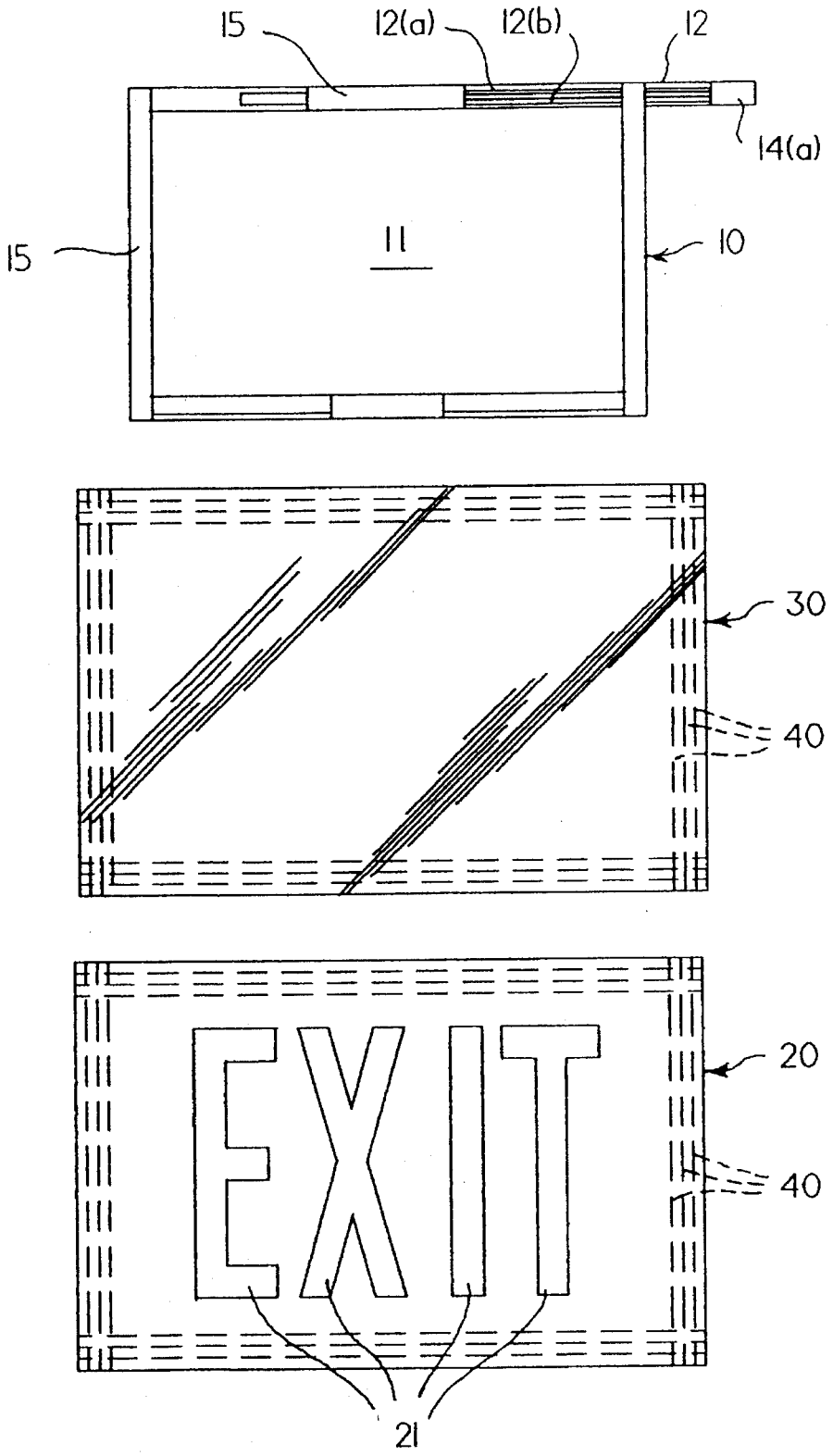
FIG. 3 is a front plan view of components of the conversion kit of the invention, including certain preferred embodiments thereof.

Referring now in particular to FIG. 3, it is further preferred that the borders of the opaque sign mask 20 and light transmissive panel 30 each be fully circumscribed by a number of spaced apart, parallel breakaway lines 40. Said lines 40 can be scored into the surfaces of the mask 20 and panel 30. However, where thermoplastic sheet materials are employed as the materials of construction for the mask 20 and panel 30, said breakaway lines can generally be readily produced by appropriate thermoforming techniques such as by vacuum forming or by impressing and running a heated multiple sawtooth disk along the borders of the sheet materials. I have found that a mask 20 or panel 30 border comprising three parallel breakaway lines 40, spaced apart from one another by about 0.25 inch to constitute a generally useful treatment whereby the mask 20 and panel 30 may be simply and readily fitted to the sign fixture (FIGS. 1 and 2) by breaking away of strips of material along appropriately selected breakaway lines 40. As will be appreciated, the breakaway line 40 array discussed above provides the potential to adjust the width and length of the opaque sign mask 20 and light transmissive panel 30 in 0.25 inch increments and with a maximum adjustment of each dimension of 1.5 inches, which is adequate to meet most conversion situations.

In making the physical installation of the illuminated sign kit of the invention the first step to be undertaken is to appropriately trim the opaque sign mask 20 and, if utilized, the light transmissive panel 30 to fit the original sign fixture.

Figure 4:
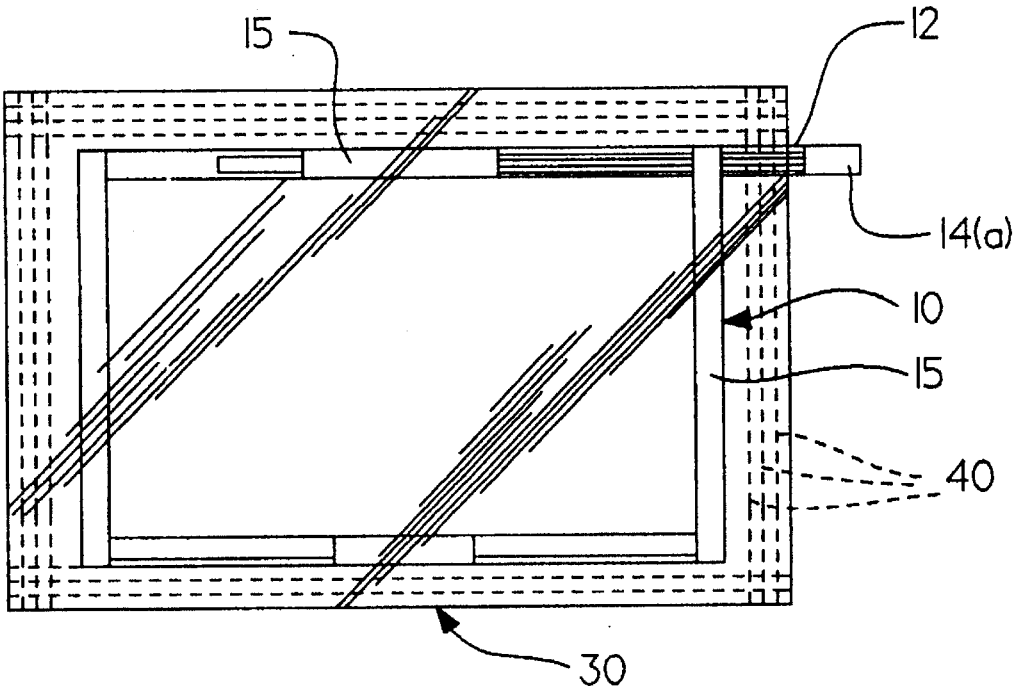
FIG. 4 is a front plan view of two of the components of the conversion kit of FIG. 3 in assembled condition.
Figure 5:
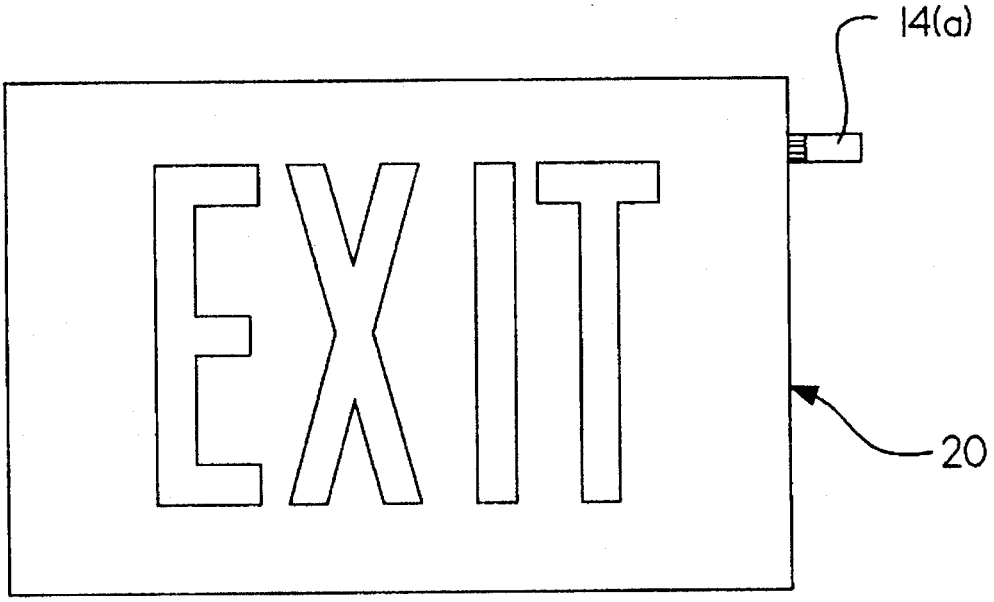
FIG. 5 is a front plan view showing all of the components of the conversion kit of FIG. 3 in assembled condition.

Next, unless the opaque sign mask 20 is already provided with the letter or symbolic indicia stencil cutouts 21 by the manufacturer, said cutouts 21 are prepared by the installer. If utilized, the correctly sized light transmissive panel 30 is disposed over the light emitting surface 11 of the electroluminescent panel 10, as shown in FIG. 4, the correctly sized opaque sign mask 20, comprising the desired stencil indicia, is disposed over the light transmissive panel 30, as shown in FIG. 5. Alternatively, the light transmissive panel 30 could be placed adjacent to the other side of the opaque sign mask 20. In either position it protects the electroluminescent panel from being struck by objects on the outside of the sign fixture. This multi-layer assembly of elements 10, 20 and 30 is then interposed between the frame 3 and flange 2', as shown in FIG. 2, and the frame 3 resecured to the flange 2' of the housing 1. Of course, where the preferred light transmissive panel 30 is not employed in the assembly, the above assembly steps relating specifically thereto are simply avoided.

Without regard to the presence or absence of the preferred light transmissive panel 30 in the illuminated sign kit of the invention, I have found that assembly of the kit is facilitated by the provision of pressure sensitive adhesive strips 15 along the edges of the light emitting surface of the electroluminescent panel 10. By the provision of said strips 15, the light transmissive panel 30 (if utilized) or opaque sign mask 20, once suitably disposed over the electroluminescent panel 10, and as shown particularly in FIG. 4 with respect to the panel 30, may be pressed lightly to the panel 10, thereby to affix the electroluminescent panel 10 in the correct position relative to the light transmissive panel 30 or the opaque sign mask 20, as the case may be.

While I have shown certain preferred embodiments of the invention, it is to be understood that the invention is not limited thereto, but may be variously embodied within the scope of the appended claims.

I claim:

1. A conversion kit for converting a sign fixture originally illuminated by incandescent bulb or fluorescent tube to electroluminescent lighting, said kit comprising:

(a) an electroluminescent panel having a light emitting surface;

(b) means for placing said electroluminescent panel into electrical communication with an AC line current power cord supplied to said sign fixture; and (c) a generally flat and thin opaque sign mask constructed of a stiff, flexible sheet material and having adjacent a perimeter thereof a plurality of spaced apart and parallel sign mask breakaway lines such that edge strips of said opaque sign mask may be broken away to adapt fitting of said opaque sign mask to said sign fixture, said opaque sign mask being adapted for receiving sign indicia in the nature of one or more stencil like cutouts therethrough prior to installation of said opaque sign mask to said sign fixture, said opaque sign mask, bearing said sign indicia, being disposable over said light emitting surface of said electroluminescent panel such that only light emitted by said light emitting surface underlying said cutouts may pass through said opaque sign mask.

2. The conversion kit of claim 1, including a generally flat and thin light transmissive panel constructed of a stiff, flexible sheet material for placement adjacent said opaque sign mask, said light transmissive panel having adjacent a perimeter thereof a plurality of spaced apart and parallel light transmissive panel breakaway lines such that edge strips of said light transmissive panel may be broken away, said light transmissive panel breakaway lines in substantial register with said sign mask breakaway lines.

3. The conversion kit of claim 2 wherein said light transmissive panel is interposed between said electroluminescent panel and said opaque sign mask.

4. The conversion kit of claim 2 wherein said plurality of spaced apart and parallel light transmissive panel breakaway lines comprises three parallel light transmissive panel breakaway lines mutually spaced apart generally by 0.25 inches.

5. The conversion kit of claim 2 wherein said light transmissive panel is composed of a sheet plastic material having a thickness of between 0.010 and 0.035 inch.

6. The conversion kit of claim 5 wherein said sheet plastic material is composed of polycarbonate resin.

7. The conversion kit of claim 2 wherein said sheet plastic material is optically clear.

8. The conversion kit of claim 2 wherein at least one edge of the light emitting surface of said electroluminescent panel has adjacent thereto a pressure sensitive adhesive strip adapted to adhere said electroluminescent panel to one of said opaque sign mask and said light transmissive panel.

9. The conversion kit of claim 1 wherein said opaque sign mask is of black coloration.

10. The conversion kit of claim 1 wherein said opaque sign mask comprises diecut indicia therethrough.

11. The conversion kit of claim 10 wherein said diecut indicia are EXIT.

12. The conversion kit of claim 1 wherein said opaque sign mask is composed of a stiff, flexible sheet plastic material having a thickness of between 0.010 and 0.035 inch.

13. The conversion kit of claim 1 wherein said plurality of spaced apart and parallel sign mask breakaway lines comprises three parallel sign mask breakaway lines mutually spaced apart generally by 0.25 inches.

14. The conversion kit of claim 1 wherein said means for electrical communication of said electroluminescent panel with said AC house line current power supply source comprises a twin conductor cable in electrical communication with said electroluminescent panel, a first connector element in electrical communication with said cable and a second connector element cooperative with said first connector element, said second connector element being adapted for electrical communication with said AC line current power cord.

15. The conversion kit of claim 1 wherein at least one edge of the light emitting surface of said electroluminescent panel comprises a pressure sensitive adhesive strip adapted to adhere said panel to said opaque sign mask.

16. The conversion kit of claim 1 wherein said light emitting surface comprises green phosphors.

* * * * *